US006893085B2

(12) United States Patent
LaPointe et al.

(10) Patent No.: US 6,893,085 B2
(45) Date of Patent: May 17, 2005

(54) ACTUATION MECHANISM FOR RECLINING CHAIR

(75) Inventors: Larry P. LaPointe, Temperance, MI (US); Chad S. Stateler, Carleton, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 10/761,110

(22) Filed: Jan. 20, 2004

(65) Prior Publication Data

US 2004/0256893 A1 Dec. 23, 2004

Related U.S. Application Data

(63) Continuation-in-part of application No. 10/601,339, filed on Jun. 20, 2003.

(51) Int. Cl.[7] ..... A47C 1/02
(52) U.S. Cl. ..... 297/85; 297/68; 297/DIG. 7
(58) Field of Search ..... 297/83–85, 68, 297/341, 258.1, DIG. 7, 330

(56) References Cited

U.S. PATENT DOCUMENTS 4,365,836 A * 12/1982 Jackson et al. ..... 297/85
5,368,366 A * 11/1994 Mizelle ..... 297/423.3
5,388,886 A * 2/1995 LaPointe et al. ..... 297/75
5,435,621 A * 7/1995 Komorowski et al. ..... 297/84
5,570,930 A * 11/1996 LaPointe et al. ..... 297/342
5,595,420 A * 1/1997 Rogers ..... 297/85
5,704,686 A * 1/1998 May ..... 297/281
5,806,921 A * 9/1998 LaPointe et al. ..... 297/85
5,992,931 A * 11/1999 LaPointe et al. ..... 297/85
6,059,367 A * 5/2000 Rogers ..... 297/423.1
6,135,559 A * 10/2000 Kowalski ..... 297/354.12
2003/0024338 A1 * 2/2003 Roither et al. ..... 74/425

FOREIGN PATENT DOCUMENTS

DE 3513334 A1 * 10/1986 ..... A47C/1/025

* cited by examiner

*Primary Examiner*—Peter M. Cuomo
*Assistant Examiner*—Stephen D'Adamo
(74) *Attorney, Agent, or Firm*—Harness, Dickey & Pierce, P.L.C.

(57) ABSTRACT

The present invention is directed to a powered actuation mechanism for a reclining chair. The powered drive mechanism rotates a drive member which engages a follower member to extend the leg rest assembly. A biasing mechanism is coupled to the leg rest assembly to retract the leg rest assembly. In this manner, the leg rest assembly may not be fully retracted when an obstruction with the leg rest assembly is encountered.

19 Claims, 10 Drawing Sheets

ACTUATION MECHANISM FOR RECLINING CHAIR

CROSS-REFERENCE TO RELATED APPLICATIONS

This application is a continuation-in-part of U.S. patent application Ser. No. 10/601,339 filed on Jun. 20, 2003. The disclosure of the above application is incorporated herein by reference.

BACKGROUND OF THE INVENTION

The present invention relates generally to reclining chairs, and more particularly to a power-assisted actuation mechanism for positioning a leg rest assembly between extended and retracted positions.

The integrated or "knock down" construction of a reclining chair utilizes unique fabrication and assembly techniques which effectively result in increased production efficiency and cost savings while concomitantly producing a high quality article of furniture. In general, the construction of these integrated reclining chairs is such that a pre-assembled actuation mechanism is integrated into pre-upholstered frame components which, when assembled, are rigidly interconnected to define a "box-like" chair frame. The pre-assembled actuation mechanism includes a drive rod and a front support shaft which are supported by and suspended between left and right side frame assemblies. Front and rear frame rail members interconnect the left and right side frame assemblies to define a "unitized" and rigid box-like chair frame.

There have also been recent developments in power-assisted chairs which include a motor-operated drive mechanism for permitting a seated occupant to actuate the leg rest assembly, to tilt the chair frame relative to the base assembly, and/or to recline the seat assembly between an upright and fully reclined position. Power-assisted chairs have, in the past, typically been targeted for very specific applications, such as to aid those persons needing assistance entering/exiting and operating the chair. In addition, persons not specifically needing assistance to operate the reclining chair find power features such as a power-assisted leg rest assembly to be a desirable convenience. Thus, there is a need for a reclining chair which combines the improved structure of a unibody chair frame with a power-assisted actuation mechanism, thereby providing a high-quality, affordable article of furniture.

SUMMARY OF THE INVENTION

In accordance with the principles of the present invention, a reclining chair having an actuation mechanism and a power-assisted drive mechanism is disclosed. The present invention provides a reclining chair having a motor-driven drive rod which can be simply and efficiently assembled so as to significantly reduce its overall complexity, weight, and cost, while providing improved operation and comfort. The present invention further provides a leg rest assembly operably coupled to the motor-driven drive rod when rotated in a first direction, but which may be uncoupled from the motor-driven drive rod when rotated in a second direction.

In one embodiment of the present invention, the reclining chair includes a pair of side assemblies interconnected at a rear portion by a rear frame rail and at a forward portion by a front frame rail. An actuation mechanism including a drive rod and a front support rod is suspended within the chair frame and operably coupled to a leg rest assembly having an pantograph linkage mechanism detachably coupled to the support shaft. The drive rod extends through a drive motor for selectively rotating the drive rod to extend the leg rest assembly. A pantograph linkage extends and retracts the leg rest in response to rotation of the drive rod by the drive motor. A drive link rotatably connected to the drive rod engages a follower link of the pantograph linkage to extend the leg rest assembly. A return spring mechanism is interconnected between the pantograph linkage and the chair frame for biasing the pantograph linkage towards the retracted position. The drive link is configured to disengage the follower link if retraction of the leg rest is obstructed, thereby uncoupling the pantograph linkage for the motor-driven drive rod.

In another embodiment of the present invention, the reclining chair includes a pair of side frame members, a front cross member secured to a front portion of the side frame members and a rear cross rail secured to a rear portion of the side frame members. An actuation mechanism includes a support shaft and a drive rod. The support shaft extends between the side frame members and is secured to the front cross member assembly. A drive motor is supported between or outside the side frame members and has a drive shaft with a drive member extending therefrom. The drive rod also extends between the side frame members and is rotatably coupled to said drive member. The reclining chair includes a leg rest assembly including a follower link and a follower member, each of which is operably coupled to and rotates with the drive rod. The leg rest assembly includes a swing link journally supported from the support shaft for rotation thereabout, and a pantograph linkage coupled to the swing link and the follower link. The drive member engages the follower member when the drive shaft is selectively rotated in a first direction to move the leg rest assembly from a retracted position towards an extended position. A return spring mechanism biases the pantograph linkage towards the retracted position. The drive member is configured to disengage the follower member if retraction of the leg rest assembly is obstructed, thereby uncoupling the pantograph linkage from the motor-driven drive shaft during retraction.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF CURRENTLY PREFERRED EMBODIMENTS

The following description of the currently preferred embodiments is merely exemplary in nature and is in no way intended to limit the invention, its application, or uses.

In accordance with the teaching of the present invention, an actuation mechanism for use in a reclining chair is disclosed. As used herein, the term "chair" is used broadly to encompass single and multi-person articles of furniture (i.e., chairs, sofas or loveseats). The present invention is readily adaptable to a "knock down" method of assembly in which the actuation mechanism is a pre-assembled and "integrated" component of the reclining chair. As presently preferred, all of the chair frame components are individually fabricated or subassembled to include the requisite brackets, springs, padding and upholstery in an "off line" batch-type basis. Subsequently, these preassembled frame components are modularly assembled for totally integrating the actuating mechanism therein.

The pre-assembled actuation mechanism is suspended from the chair frame components so as to provide precise mechanical alignment and superior structural rigidity while employing a highly efficient fabrication and assembly process. As presently preferred, the reclining chair may be capable of a variety of relative motions, namely independent recline of a seat back relative to a seat member, movement of a leg rest assembly between retracted and extended positions, and relative motion between the chair frame and the base assembly such as rocking, tilting, gliding and translating. Moreover, a full range of independent reclining movement of the seat back relative to the seat member is possible regardless of the operative position of the leg rest assembly between the retracted and extended positions. As used herein, the term "reclining" is used broadly to encompass any of such relative motions alone or in combination.

Figure 1:
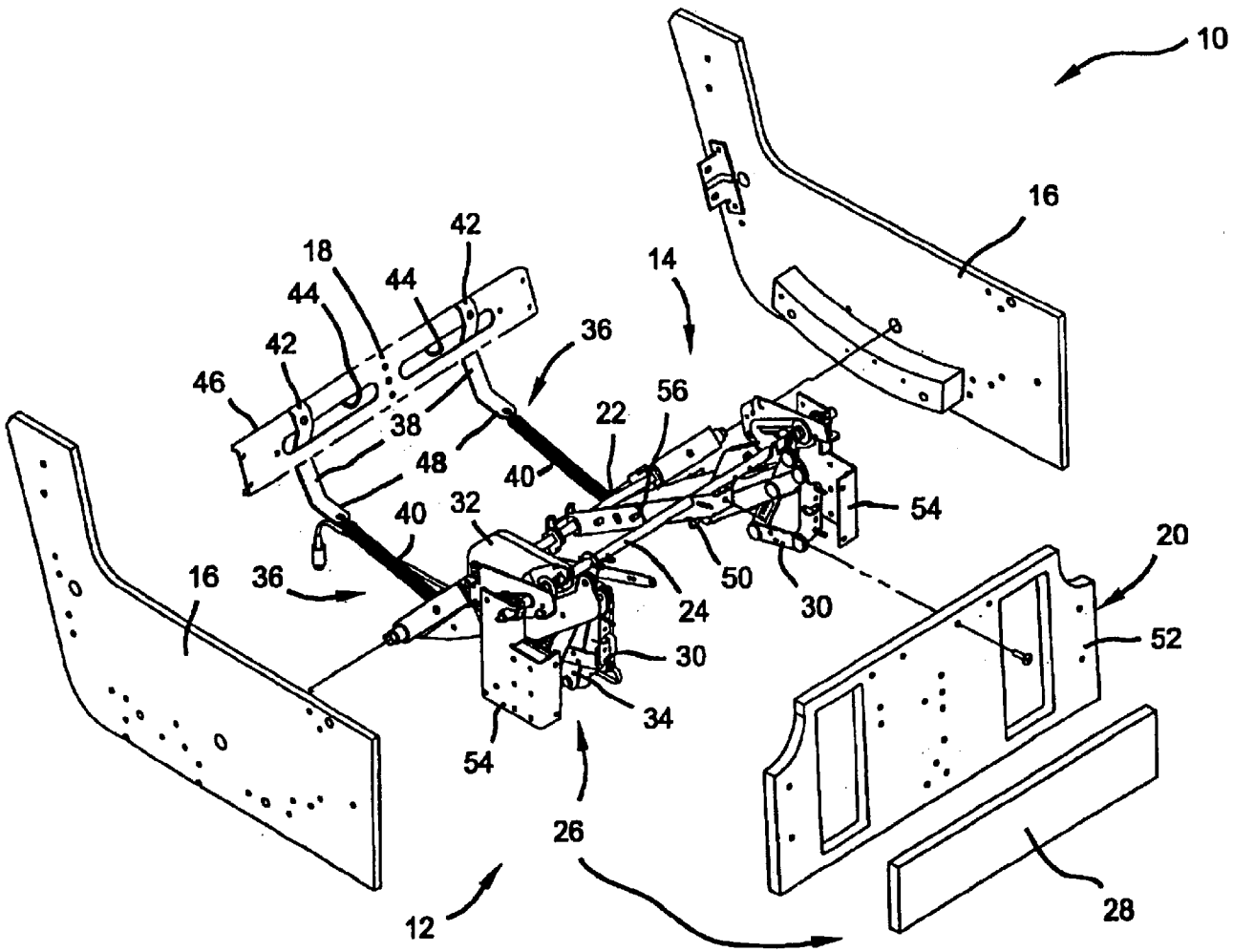
FIG. 1 is an partial exploded perspective view of a reclining chair in accordance with a first preferred embodiment incorporating the actuation mechanism of the present invention.

With particular reference now to the drawings, the functional and structural aspects of the present invention will now be described. FIG. 1 illustrates the present invention incorporated into reclining rocking chair 10. Reclining rocking chair 10 is substantially similar in function and structure to the chairs illustrated and disclosed in U.S. Pat. No. 5,806,921 issued on Sep. 15, 1998 which is commonly owned by the assignee of the present invention, and the disclosure of which is expressly incorporated by reference herein. Accordingly, only those aspects of reclining rocking chair 10 which relate to the present invention will be described in detail herein. A more detailed description of the mechanisms associated with this type of chair can be found in the above-identified United States patent incorporated by reference herein.

Chair 10 includes a chair frame assembly 12 and actuation mechanism 14 operatively suspended from chair frame assembly 12. Chair frame assembly 12 includes side frame assemblies 16 interconnected at a rear edge by rear frame rail member 18 and interconnected at a front edge by front frame member assembly 20 to define a rigid "box-like" chair frame. Actuation mechanism 14 is preassembled to include drive rod 22 and front support shaft 24, both of which are spatially oriented to be precisely located and suspended from side frame assembly 16. Actuation mechanism 14 is shown to support leg rest assembly 26 thereon. More specifically, leg rest assembly 26 includes left and right pantograph linkages 30 both of which are operably associated with drive rod 22 and front support shaft 24 for retracting and extending leg rest board 28 in response to rotation of drive rod 22.

A drive motor 32 is operably coupled to drive rod 22 provide a motor-driven drive rod. As presently preferred, drive rod 22 is a one-piece element which extends through the gear set of drive motor 32 at the rearward portion of the drive motor 32. One skilled in the art will recognize that the drive motor which is shown within the actuation 14 may be located at other positions. In this regard, the drive motor 32 may be located outboard of the location shown. For example, the drive motor 32 may be located within an arm or other cavity of one of the side frame assemblies. The front portion of the drive motor 32 is supported by motor brace 34 extending downwardly from front support shaft 24. The drive mechanism further includes motor control circuitry (not shown) to selectively operate the drive motor through the range of motion without overload thereof. A presently preferred drive motor is the subject of U.S. application Ser. No. 10/196,851, the disclosure of which is expressly incorporated by reference herein.

Left and right return spring mechanisms 36, hereinafter referred to singularly, are interconnected between pantograph linkage 30 and rear frame rail member 18. The return spring mechanism 36 includes a support bracket 38 extending from the rear frame rail member 18 and a spring member 40 interposed between the rear frame rail member 18 and the pantograph linkage 30. As presently preferred, spring member 40 is a helical coil spring having a relatively high preload to maintain the leg rest assembly in a retracted position and a relatively low spring rate to minimize the retraction force. Tuning the spring member accordingly minimizes the counter force which the drive motor 32 must overcome to rotate the drive rod, while at the same time minimizes the retraction force imparted on an obstruction of the leg rest assembly.

Figure 4:
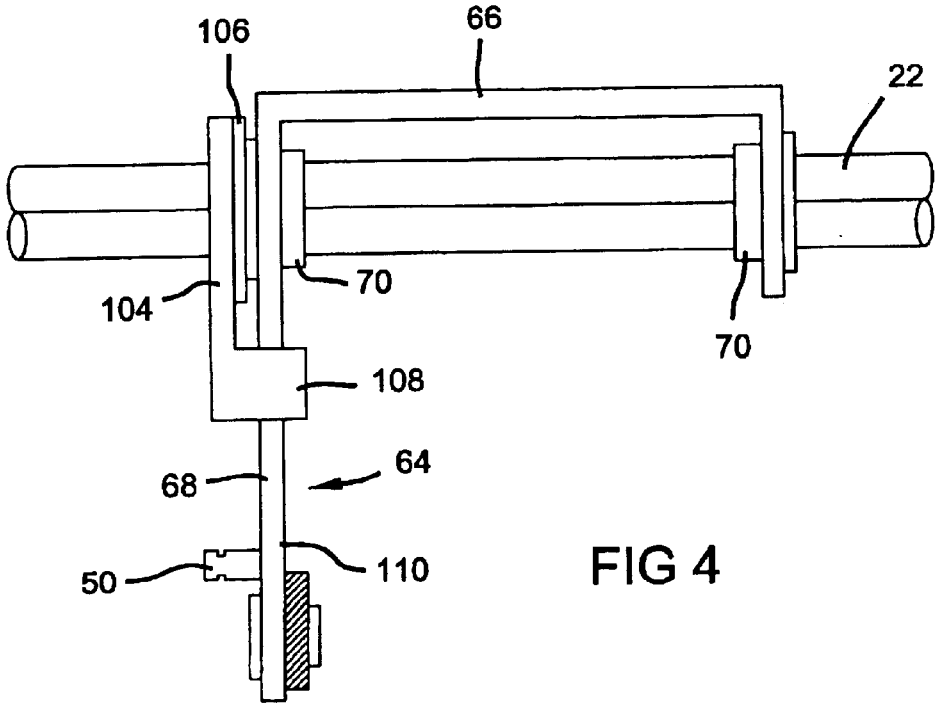
FIG. 4 is a detail of the drive link and follower link of FIG. 3.

The support bracket 38 has a hook portion 42 which extends through a slot 44 formed in the rear frame rail member 18 and captures the upper edge 46 thereof. Support bracket 38 is cantilevered from the chair frame 12 and extends downwardly and forwardly from the rear frame rail member 18 and terminates at end 48 which receives one end of spring member 40. The bracket 38 is able to support the spring of the spring member 40 without fasteners securing it to the chair frame assembly 12. As such, the position of the support bracket 38 relative to the rear frame rail 18 may be readily adjusted. A stud 50 (as shown in FIG. 4) extends from pantograph linkage 30 and receives the other end of spring member 40. Return spring mechanism 36 biases the follower link 64 rearwardly in a counterclockwise direction to urge the pantograph linkage 30 towards the retracted position.

Front frame member assembly 20 is a multi-piece assembly including front frame board 52 and a pair of front frame brackets 54 extending from opposite lateral ends of front frame board 52. Spacer link 56 is interconnected between drive rod 22, front support shaft 24 and frame board 52 to further integrate actuation mechanism 14 with chair frame assembly 12.

Figure 2:
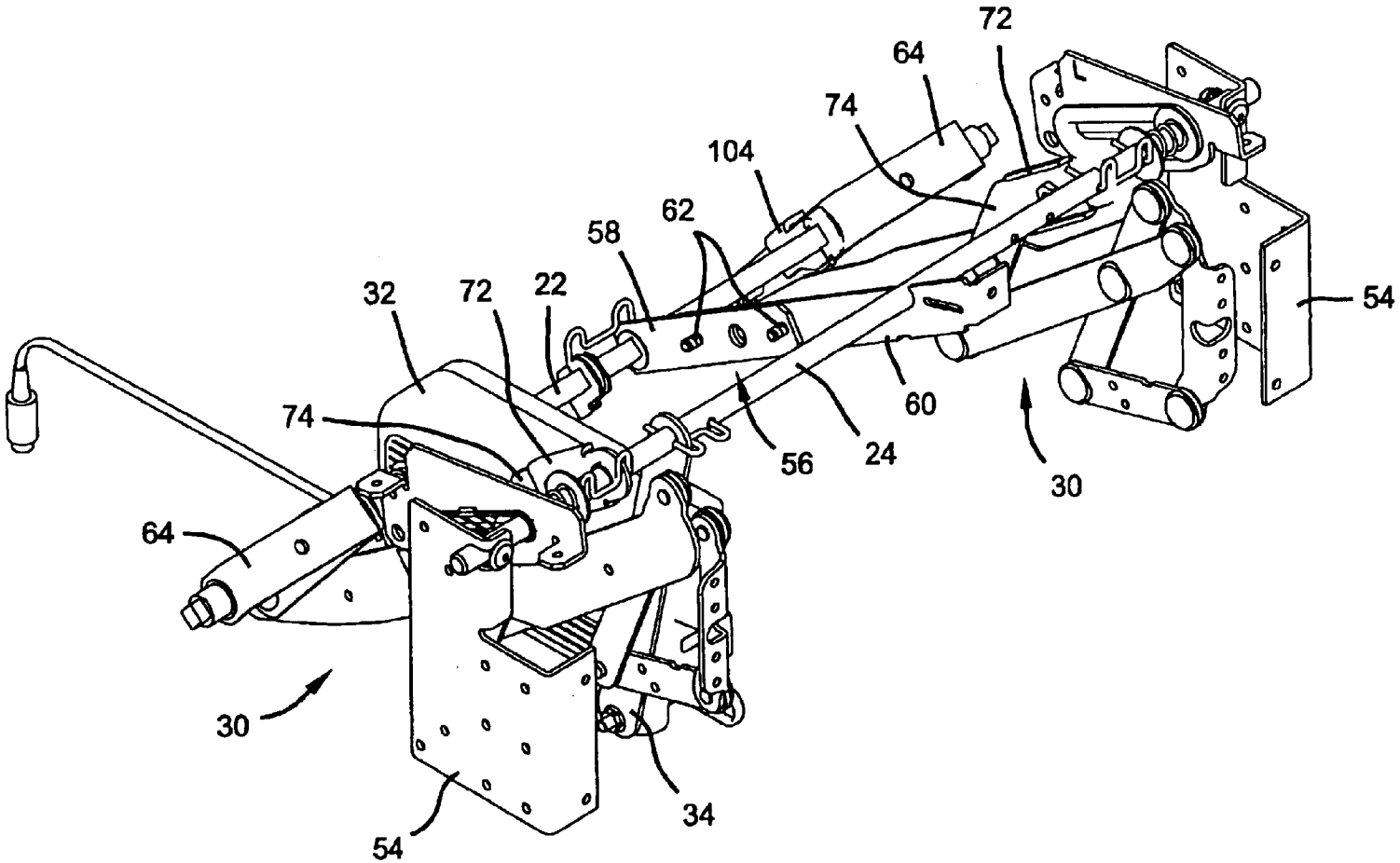
FIG. 2 is an assembled perspective view of the actuation mechanism shown in FIG. 1.
Figure 3:
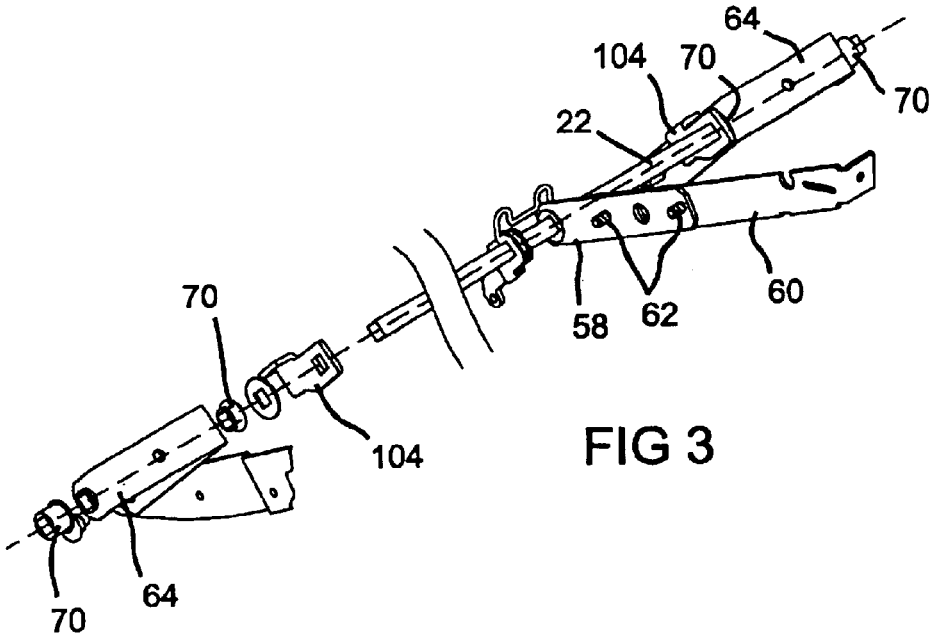
FIG. 3 is a partially exploded perspective view of a portion of the actuation mechanism shown in FIG. 2.

As best seen in FIGS. 2 and 3, spacer link 56 includes a rear brace 58 generally supported on drive rod 22 which extends forwardly and upwardly towards the front support shaft 24. Thus, the rear brace 58 of spacer link 56 is supported by drive rod 22, while permitting relative rotation therein. Spacer link 56 also includes a front brace 60 that receives front support shaft 24 near the upper end thereof. Front brace 60 extends forwardly and upwardly from front support shaft 24 and is secured to front frame board 52 to provide cantilevered support for the drive rod 22 through the rear brace 58. Front brace 60 and rear brace 58 of spacer link 56 are secured together with threaded fasteners 62.

In this way, the front brace 60 and rear brace 58 may be separated to facilitate field service and replacement of the actuation mechanism without further requiring disassembly of the chair frame assembly 12. Specifically, the drive rod 22 along with the drive motor 32 may be uncoupled and removed from the chair frame assembly 12 without requiring excessive disassembly of the unit. Specifically, the spring members 40 are uncoupled from the follower link 64. Next, the various links—leg rest swing arm 74, follower link 64 and rear brace 58—are uncoupled from the drive rod 22. Then, the rear brace 58 is uncoupled from the front brace 60 by removing fasteners 62. Lastly, the motor mount 34 is uncoupled from the drive motor 32. At this point the drive rod 22 and drive motor 32 may be moved laterally relative to the remaining component of the chair and removed therefrom. Once the drive motor 32 has been serviced or replaced, the drive rod 22 and drive motor may be re-installed using the reverse of the sequence described above.

Right and left hand pantograph linkages 30 hereinafter referred to singularly, are operably suspended from drive rod 22 and front support shaft 24. More specifically, pantograph linkage 30 includes a follower link 64 generally supported on the drive rod 22. The follower link 64 is generally L-shaped having a transverse leg 66 extending generally parallel to drive rod 22 and a longitudinal leg 68 extending perpendicularly away from drive rod 22. A pair of bushings 70 journally support the follower link 64 on the drive rod 22. Thus, drive rod 22 is able to rotate relative to follower link 64.

Similarly, pantograph linkage 30 is suspended from front support shaft 24 by leg rest swing bracket 72. Leg rest swing bracket 72 receives front support shaft 24 and is releasably secured to leg rest swing arm 74. Threaded fastener 76 releasably secures leg rest swing arm 74 with leg rest swing bracket 72. In this way, the pantograph linkage 30 may be detached from the drive rod 22 and front support shaft 24 to facilitate field service and replacement thereof without further requiring disassembly of the chair frame assembly 12.

Pantograph linkage 30 further includes support link 78 pivotally connected at pivot 80 to connection link 82, which is pivotally connected at pivot 84 with front board link 86 which is in turn pivotally connected at pivot 88 with leg rest bracket 90. Similarly, leg rest swing arm 74 is pivotally connected at pivot 92 to rear board link 94 which is turn pivotally connected at pivot 96 to leg rest bracket 90. Leg rest swing arm 74 is pivotally coupled at intermediate pivot 98 with support link 78. Rear board link 94 is pivotally coupled at intermediate pivot 100 with connection link 82. Follower link 64 is pivotally coupled at pivot 102 with support link 78. In this manner, pantograph linkage 30 provides means for articulating the leg rest assembly between a retracted position as illustrated in FIG. 5 to a fully extended position as illustrated in FIG. 6.

Figure 7:
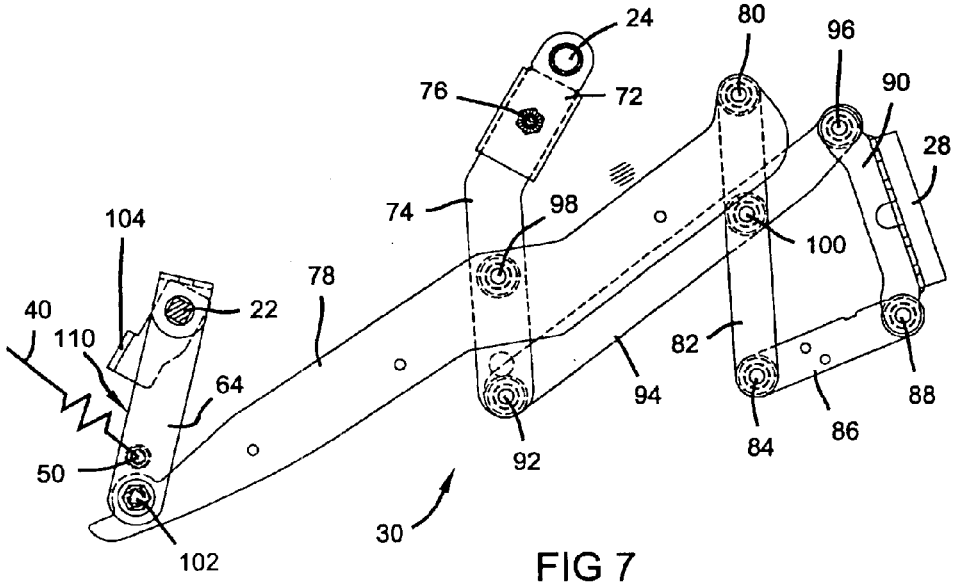
FIG. 7 is a side view similar to FIG. 5 illustrating the leg rest assembly in an obstructed state with the drive link disengaged from the follower link.

Drive link 104 is supported on and rotates with drive rod 22. Specifically, drive link 104 receives drive rod 22 and is rotatably coupled thereto. Nylon washer 106 is interposed between drive link 104 and bushing 70. Transverse flange 108 extends laterally outwardly from drive link 104 and is adapted to engage the rearward edge 110 of follower link 64. Accordingly, selective rotation of drive rod 22 in a counter-clockwise direction (as shown in FIGS. 5–7) rotates drive link 104 causing transverse flange 108 to engage rear edge 110 of follower link 64, thereby rotating follower link 64 in a counter-clockwise direction. Follower link 64 which acts through pivot 102 moves support link 78. Such movement of support link 78 causes leg rest swing arm 74 to rotate about front support shaft 24 moving rear board link 94 outwardly and upwardly. In addition, the pivotally coupling of support link 98 with connection link 82 and front board link 86 results in coordinated upward and outward movement of front board link 86. Extension of left and right hand pantograph linkages 30 is simultaneous to position the leg rest assembly from a stored or retracted position shown in FIG. 5 to an extended or protracted position as shown in FIG. 6.

As described herein, follower link 64 and drive link 104 function as a clutch mechanism for operably coupling the drive rod 22 with the pantograph linkage 30. Specifically, the clutch mechanism operates in a driven mode for a first direction to couple the drive rod 22 and the pantograph linkage 30 for positioning the leg rest assembly 26 from a retracted position towards an extended position. The clutch mechanism operates in a free-wheeling mode for a second direction to uncouple the drive rod 22 and the pantograph linkage.

Figure 5:
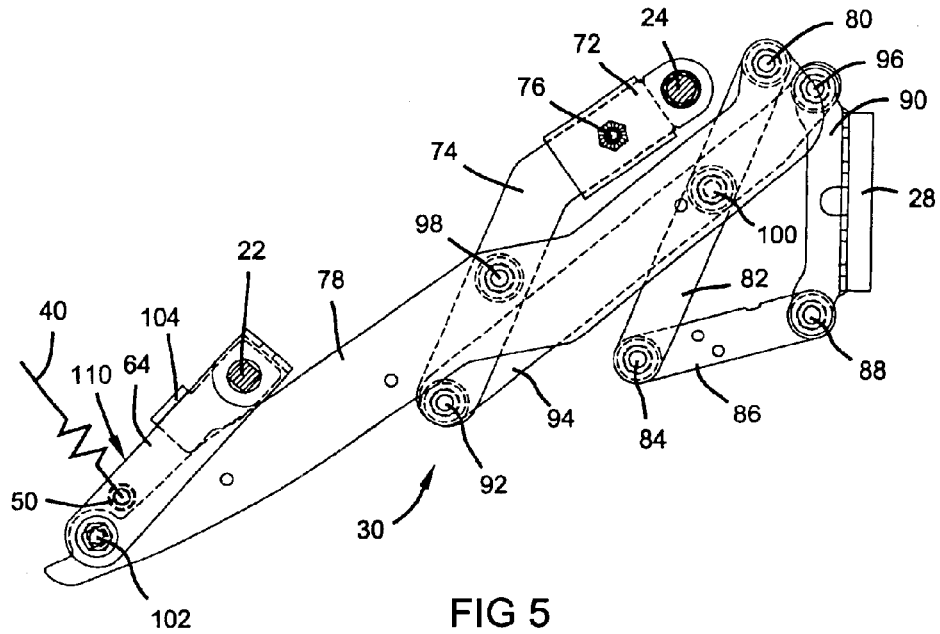
FIG. 5 is a side view illustrating a portion of the leg rest assembly in a retracted position.
Figure 6:
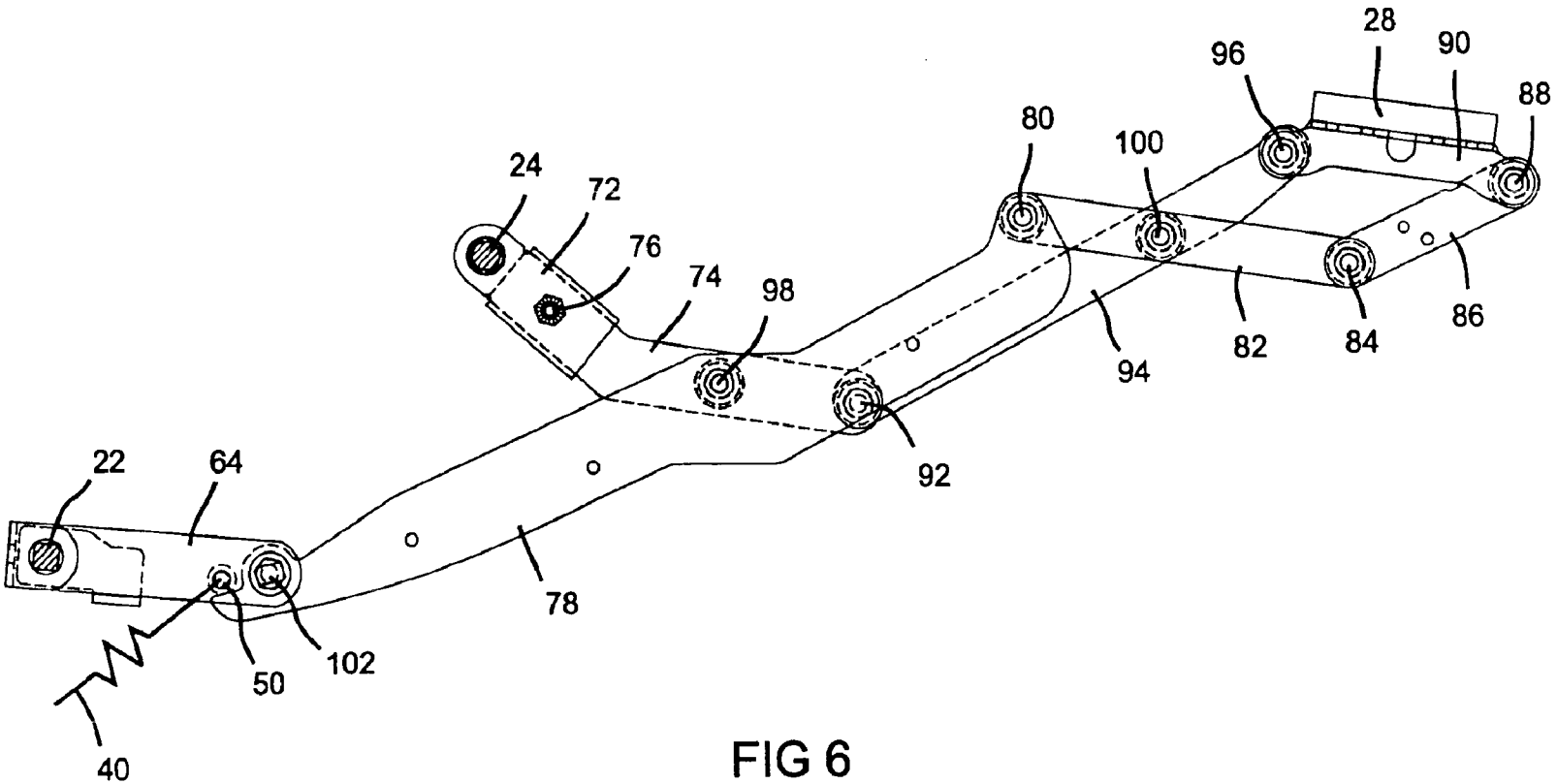
FIG. 6 is a side view similar to FIG. 5 illustrating the leg rest assembly in an extended position.

Counter rotation of the drive rod 22 in the clockwise direction (as shown in FIGS. 5–7) rotates drive link 104 in a clockwise direction. The rearward biasing force generated by spring member 40 of return spring mechanism 36 rotates follower link 64 in a clockwise direction to maintain contact with transverse flange 108 of drive link 104. In this manner, counter rotation of the drive rod 22 moves the pantograph linkage 30 towards the retracted position. Should the pantograph linkage 30 encounter an obstruction during counter rotation of drive rod 22, counter rotation of follower link 64 stops and transverse flange 108 of the drive link 104 disengages follower link 64 to permit continued counter rotation of drive rod 22. Further retraction of the pantograph linkage 30 is prevented since the follower link 64 and the leg rest swing arm 74 are journally supported on the actuation mechanism 14. Once the obstruction is removed, follower link 64 counter rotates to engage drive link 104 and the leg rest assembly 26 may be fully retracted by the return spring mechanism 36. In this manner, the motor-assisted drive rod 22 cannot power retract an obstructed leg rest assembly.

A second embodiment of the reclining chair 10' having an actuation mechanism 14' is illustrated in FIGS. 8–14. Elements common to the first and second embodiments are designated with common reference numerals and their description is not repeated for the second embodiment. New elements of the second embodiment are designated with new reference numerals and are not followed by a prime.

Figure 8:
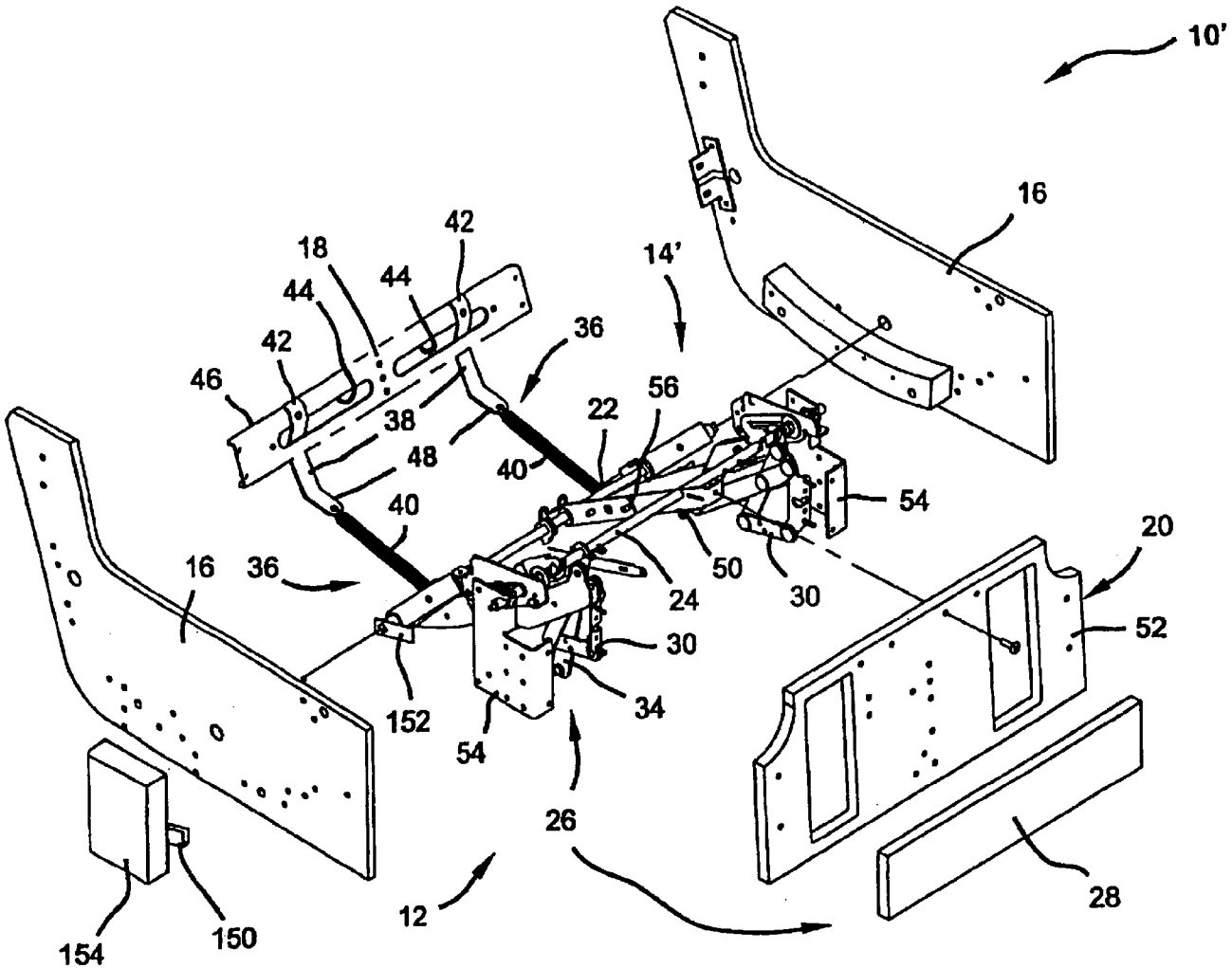
FIG. 8 is an partial exploded perspective view of a reclining chair in accordance with a second preferred embodiment of the actuation mechanism of the present invention.
Figure 11:
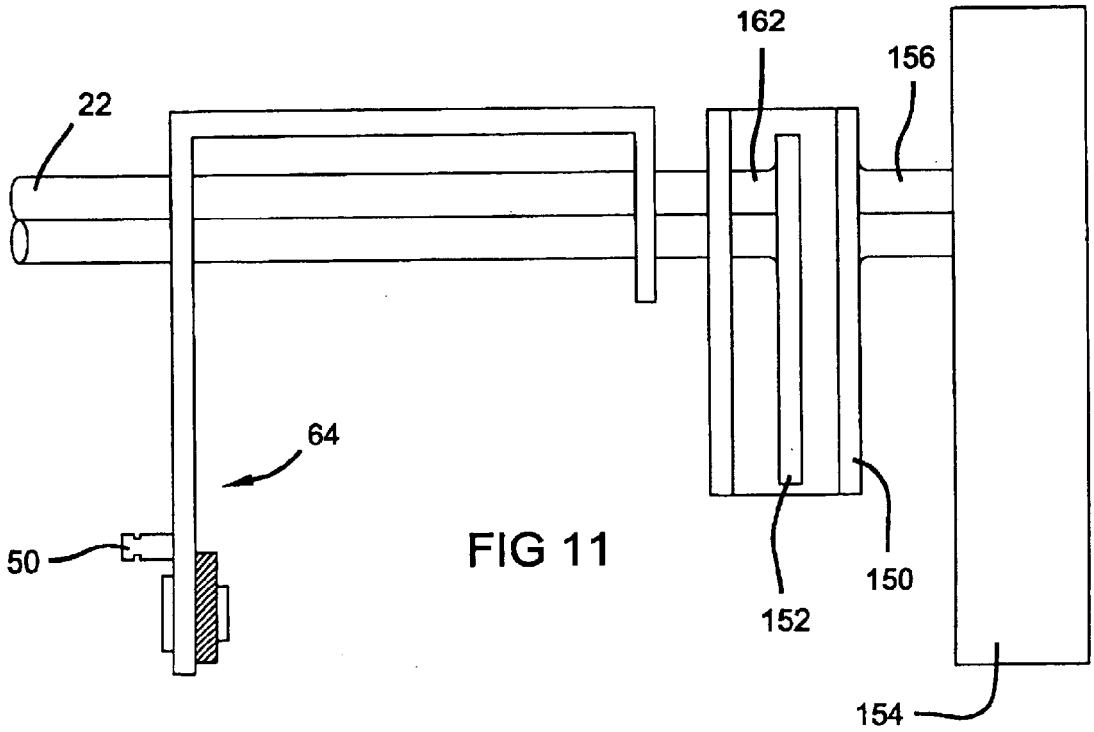
FIG. 11 is a detail of the drive member and follower member of FIG. 10.
Figure 12:
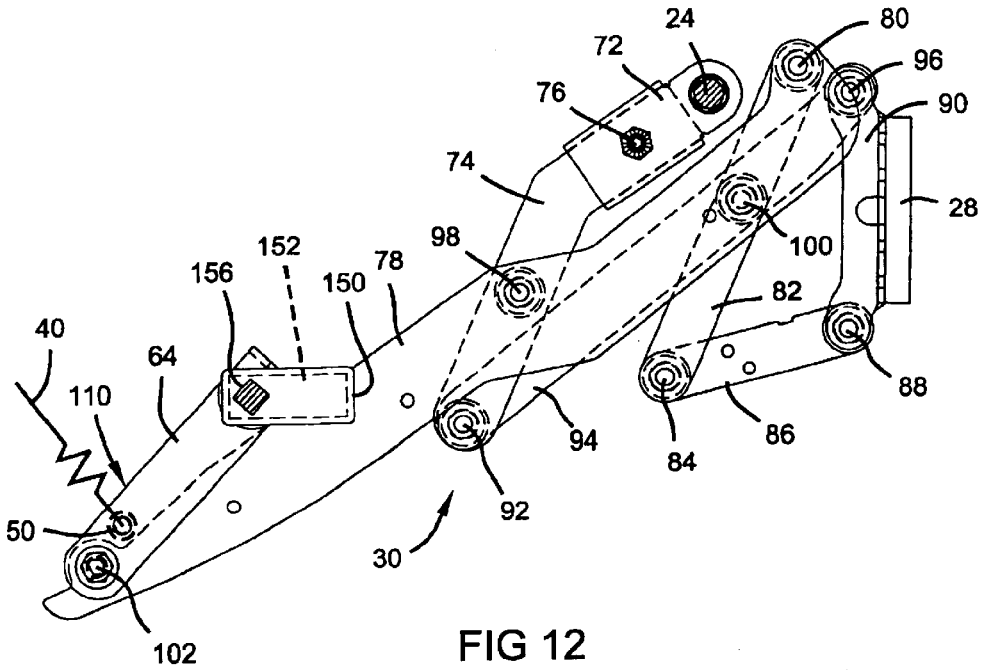
FIG. 12 is a side view illustrating a portion of the leg rest assembly in a retracted position.
Figure 14:
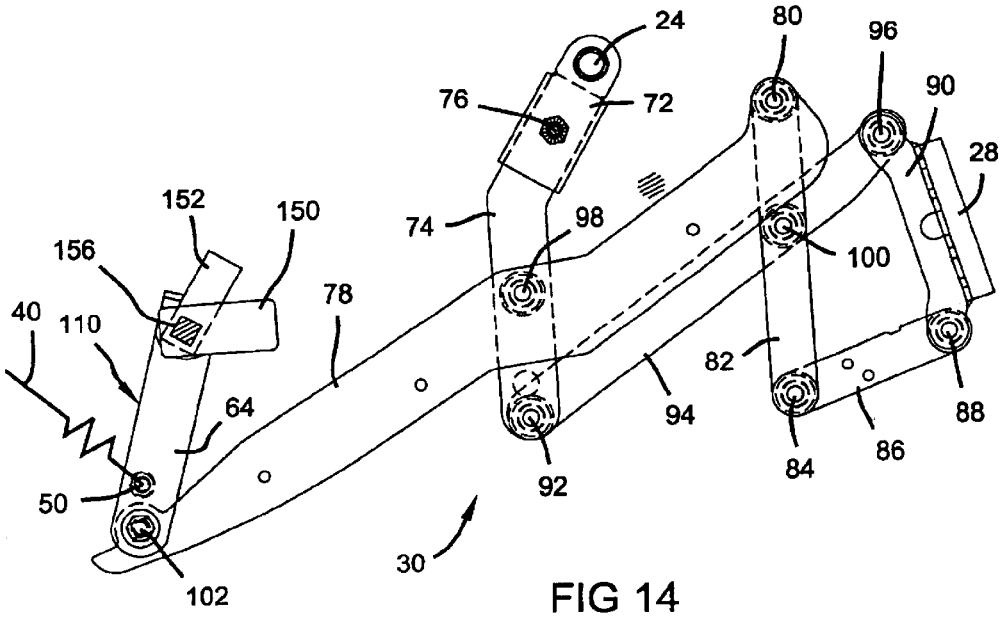
FIG. 14 is a side view similar to FIG. 12 illustrating the leg rest assembly in an obstructed state with the drive member disengaged from the follower member.
Figure 13:
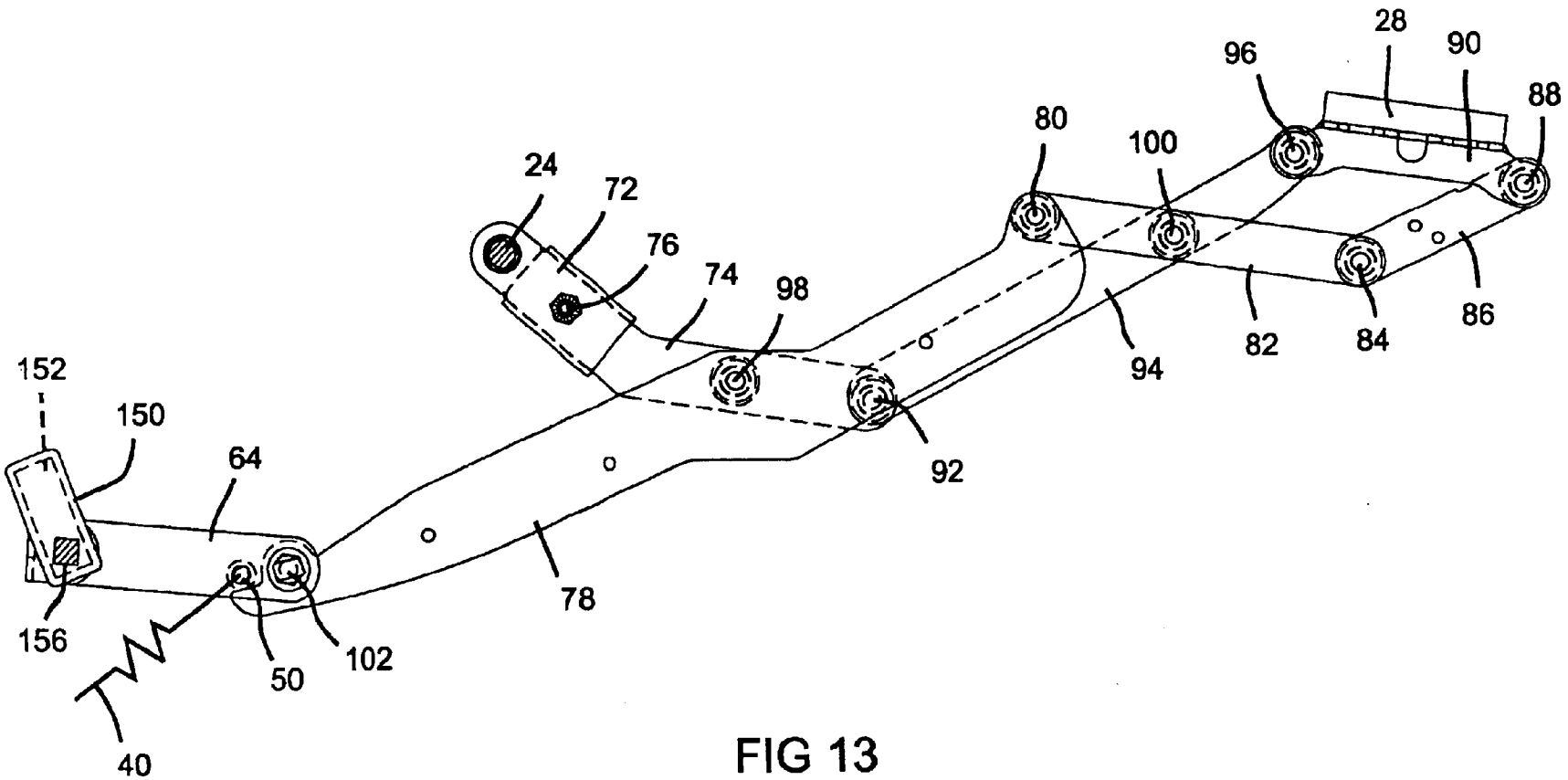
FIG. 13 is a side view similar to FIG. 12 illustrating the leg rest assembly in an extended position.

Referring to FIGS. 8 and 11, the reclining chair 10 includes an operator 154, which could be a powered actuator, such as an electric motor, a pneumatic drive, a hydraulic drive, or a gas-assisted spring drive or a manual actuator, such as a handle. In an embodiment which employs an electric motor, a corded or cordless handheld device (not shown) can be used to control the electric motor. The operator 154 imparts rotational motion to a drive shaft 156 which is coupled with a drive member 150 for rotation therewith. The operator 154 is preferably mounted outside the chair frame assembly 12 adjacent to one of the side frame members 16 for easy access or retrofitting of existing non-powered reclining chairs. It will be appreciated, however, that the operator 154 may be also mounted between the side frame members 16.

One end 158 of the drive member 150 is coupled with the drive rod 22 for relative rotation thereabout. As presently preferred, the drive member 150 has a U-shaped cross-section defining a channel 160. A follower member 152 is attached to and rotates with the drive rod 22 at an end 162 that is located within the channel 160. The drive member 150 always rotates with the drive shaft 156, while the follower member 152 always rotates with the drive rod 22. The pantograph drive link 64 is coupled to rotate with the rod 22.

Figure 9:
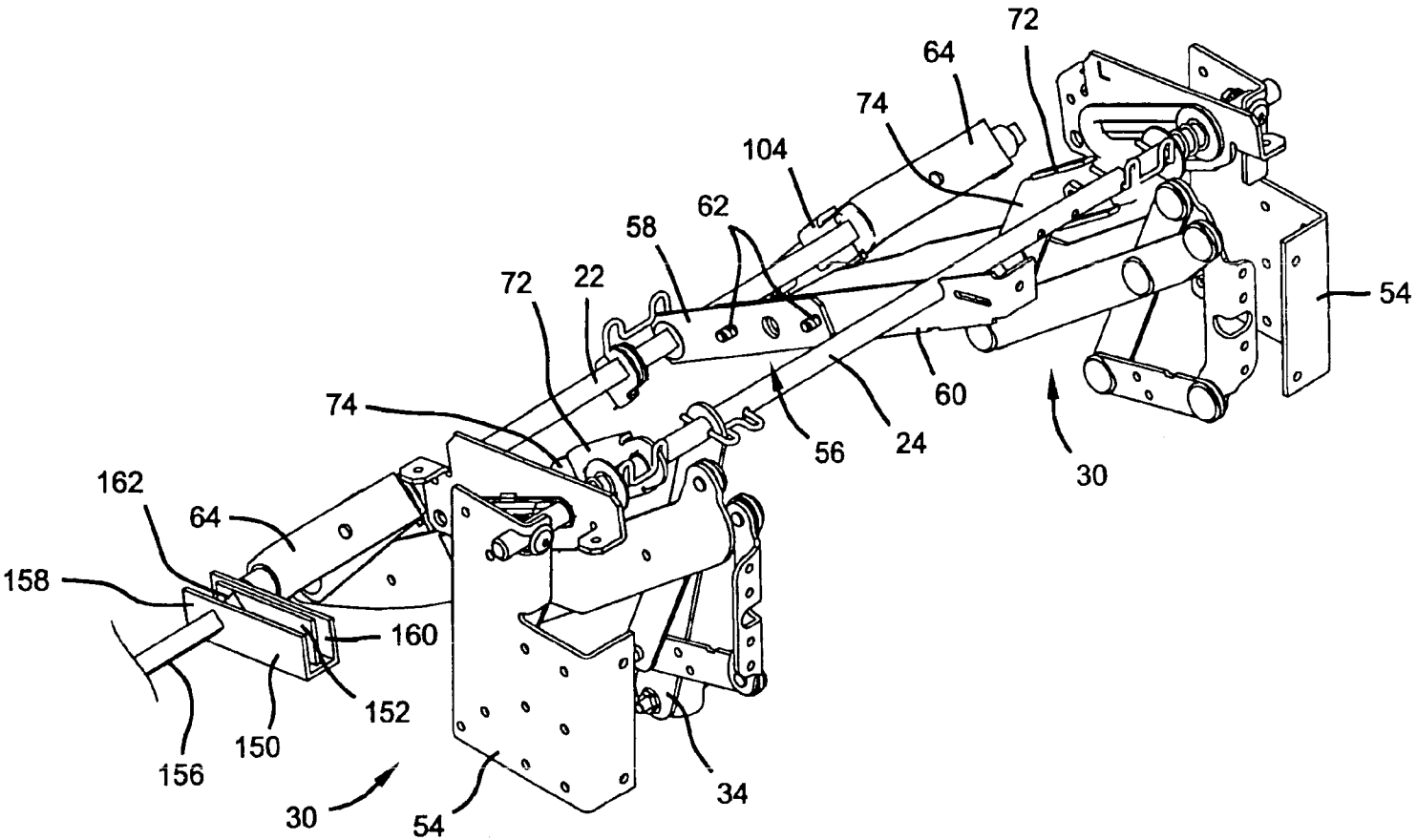
FIG. 9 is an assembled perspective view of the actuation mechanism shown in FIG. 8.
Figure 10:
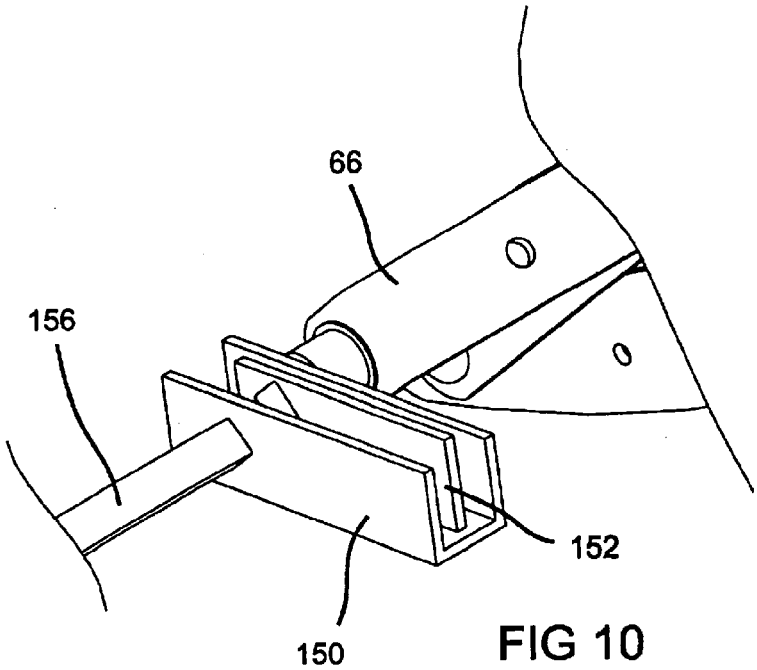
FIG. 10 is a partially exploded perspective view of a portion of the actuation mechanism shown in FIG. 9.

In operation, selective rotation of the drive shaft 156 in a counterclockwise direction, as viewed in FIGS. 8 and 9, causes the drive member 150 to rotate counterclockwise engaging the follower member 152 and forcing the follower member 152 to also rotate counterclockwise. The follower member 152 causes the drive rod 22 to rotate in the counterclockwise direction. It will be appreciated that the characterizations "drive" and "follower" are relative characterizations which may correspond to interchangeable functions depending on a frame of reference. Thus, the follower member 152 follows drive member 150 with respect to the rotation of the drive shaft 156, while it functions as a driver with respect to the rotation of the drive rod 22. As the drive rod 22 rotates counterclockwise, so does the pantograph drive link 64, causing the right and left pantograph linkages 30 to extend, bringing the leg rest assembly 26 from a stowed or retracted position shown in FIG. 12, to an extended or protracted position shown in FIG. 13.

The drive member 150 coupled to the operator 154 and the follower member 152 coupled with the drive rod 22 function as a clutch mechanism for operably coupling the operator 154 with the pantograph linkages 30. Similar to the first preferred embodiment, the clutch mechanism defined by drive member 150 and follower member 152 operates in a driven mode for a first direction to couple the operator 154 and the pantograph linkages 30 for positioning the leg rest assembly 26 from a retracted position towards an extended position. The clutch mechanism operates in a free-wheeling mode for a second direction to uncouple the operator 154 and the pantograph linkages 30.

Counter rotation of the drive shaft 156 in a clockwise direction counter rotates the drive member 150. The rearward biasing force generated by the spring member 40 of the return spring mechanism 36 rotates the pantograph drive link 64 and drive rod 22 in a clockwise direction, thus moving the pantograph linkage 30 towards the retracted position while maintaining engagement of the follower link 152 with the drive link 150. Should the pantograph linkage 30 encounter an obstruction during counter rotation, follower member 152 disengages from drive member 150 and counter rotation of the pantograph drive link 64 and rod 22 stops. Counter rotation of drive member 150 and drive shaft 156 continues as the operator 154 is further rotated in a clockwise direction. Further retraction of the pantograph linkage 30 is therefore prevented. Once the obstruction is removed, follower member 152 continues to counter rotate until it re-engages with the drive member 150 under the action of the springs 40, and the leg rest assembly 26 may be fully retracted by the return spring mechanism 36. In this manner, the drive shaft 156 cannot power-retract the leg rest assembly 26, when it is obstructed.

While the foregoing description of the first embodiment 10 includes a motor-driven drive rod, one skilled in the art will recognize that a manually-operated drive rod could be employed with the present invention which prevents retraction of an unobstructed leg rest assembly. Likewise, the second preferred embodiment has been illustrated with a pair of return springs 40 interconnected between the chair frame 12 and the pantograph drive link 64. However, one skilled in the art will recognize that other biasing means may be employed to import a counter rotation manual on the drive rod 22. For example, a single downwardly extending link coupled to the drive rod 22 and a single return spring interconnected between this link and the chair frame 12 could be used. Alternately, a toggle link mechanism for providing over-center biasing of the drive rod such as that described in U.S. Pat. No. 5382,073 could be used as biasing means in the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A reclining chair comprising:

a chair frame assembly including a pair of side frame members, a front cross member secured to a front portion of said side frame members and a rear cross rail secured to a rear portion of said side frame members;

an operator having a drive shaft extending therefrom;

an actuation mechanism having a drive rod supported for rotation between said side frame members;

a leg rest assembly including a pantograph linkage coupled to the drive rod; and a clutch mechanism operably coupled between said drive shaft and said drive rod, said clutch mechanism operable in a first direction to couple said drive rod and said drive shaft for positioning said leg rest assembly from a retracted position towards an extended position and operable in a second direction to uncouple said drive rod and said drive shaft, wherein said clutch mechanism comprises a drive member coupled to said drive shaft for rotation therewith and a follower member coupled to said drive rod for rotation therewith.

2. The reclining chair of claim 1, wherein said operator is manually powered.

3. The reclining chair of claim 1, wherein engages said drive member said follower member when said drive shaft is rotated in a first direction for rotating said drive rod in a first direction positioning said leg rest assembly from a retracted position towards an extended position.

4. The reclining chair of claim 3, wherein said drive member comprises a channel, said follower member being received in said channel and engaging said drive member when said drive shaft is rotated in said first direction.

5. The reclining chair of claim 1 further comprising a retun spring connected between said chair frame and said actuation mechanism to bias said drive rod for rotation in a second direction.

6. The reclining chair of claim 5 further comprising a link rotatably coupled to said drive rod, said return spring being connected between said chair frame and said link.

7. The reclining chair of claim 6 wherein said link forms a part of said leg rest assembly.

8. The reclining chair of claim 1, wherein said operator comprises a powered actuator.

9. The reclining chair of claim 8, wherein the powered actuator comprises an electric motor mounted outside said chair frame assembly.

10. A leg rest assembly positionable between a retracted position and an extended position, said leg rest assembly comprising:

a drive shaft with a drive member rotatably coupled thereto;

an actuation mechanism including a drive rod with a follower member rotatably coupled thereto;

a pantograph linkage interconnecting a leg rest panel and the drive rod for coordinated articulated movement between a retracted position and an extended position, said pantograph linkage supported from said actuation mechanism, said drive member engaging said follower member when said actuation mechanism is rotated in a first direction for positioning said leg rest panel from said retracted position to said extended position; and a return spring mechanism biasing said pantograph linkage towards said retracted position.

11. The leg rest assembly of claim 10 wherein said actuation mechanism further comprises a support shaft, and a swing link coupled to said pantograph linkage and journally supported from said support shaft for rotation thereabout.

12. The leg rest assembly of claim 10 wherein said drive member is operable to disengage said follower member when said drive shaft is rotated in second direction.

13. The leg rest assembly of claim 10 wherein said return spring mechanism comprises:

a link coupled to the drive rod for rotation therewith; and a spring operably coupled to the link to bias the drive rod in the second direction.

14. The leg rest assembly of claim 10 wherein the drive member comprises a channel, the follower member being received in the channel and engaging the drive member when the drive shaft is rotated in the first direction.

15. The leg rest assembly of claim 10 further comprising an operator coupled to said drive shaft to rotate said drive member.

16. The leg rest assembly of claim 15 wherein said operator comprises an electric motor.

17. A reclining chair comprising:

a chair frame assembly including a pair of side frame members, a front cross member secured to a front portion of said side frame members and a rear cross rail secured to a rear portion of said side frame members;

a support shaft extending between said side frame members and secured to said front cross member assembly;

a drive rod extending between said side frame members having a follower member rotatably coupled thereto;

an operator having a drive shaft with a drive member rotatably coupled thereto;

a leg rest assembly including a drive link coupled to said drive rod for rotation therewith, a swing link journally supported from said support shaft for rotation thereabout, and a pantograph linkage operably coupled to said swing link and said drive link;

said drive member engaging said follower member when said drive shaft is rotated in a first direction for positioning said leg rest assembly from a retracted position towards an extended position;

a return spring mechanism biasing said pantograph linkage towards said retracted position; and wherein said drive member is operable to disengage said follower member when said drive shaft is rotated in a second direction.

18. The reclining chair of claim 17 wherein the operator comprises a powered actuator.

19. The reclining chair of claim 18 wherein the powered actuator comprises a drive motor is mounted on a side of the chair frame assembly laterally outboard of one of said pair of side frame members.

* * * * *